US012735982B2

(12) United States Patent
Zhang et al.

(10) Patent No.: US 12,735,982 B2
(45) Date of Patent: Sep. 15, 2026

(54) METHODS AND SYSTEMS FOR DETERMINING WELL SHUT-IN PRESSURES OF OIL AND GAS WELL DRILLING

(71) Applicant: SOUTHWEST PETROLEUM UNIVERSITY, Chengdu (CN)

(72) Inventors: Jie Zhang, Chengdu (CN); Rongxin Li, Chengdu (CN); Cuinan Li, Chengdu (CN); Ping Pang, Chengdu (CN); Yu Qing, Chengdu (CN); Liuyang Wang, Chengdu (CN); Runze Li, Chengdu (CN)

(73) Assignee: SOUTHWEST PETROLEUM UNIVERSITY, Chengdu (CN)

( * ) Notice: Subject to any disclaimer, the term of this patent is extended or adjusted under 35 U.S.C. 154(b) by 428 days.

(21) Appl. No.: 18/523,838

(22) Filed: Nov. 29, 2023

(65) Prior Publication Data

US 2025/0101865 A1 Mar. 27, 2025

(30) Foreign Application Priority Data

Sep. 27, 2023 (CN) ..... 202311254721.0

(51) Int. Cl.
*E21B 49/00* (2006.01)
*E21B 47/002* (2012.01)
(Continued)

(52) U.S. Cl.
CPC ..... *E21B 49/005* (2013.01); *E21B 47/0025* (2020.05); *E21B 47/06* (2013.01);
(Continued)

(58) Field of Classification Search
CPC .. E21B 49/005; E21B 47/0025; E21B 49/087; E21B 2200/20; E21B 2200/22
See application file for complete search history.

(56) References Cited

U.S. PATENT DOCUMENTS 3,900,068 A * 8/1975 Scott ..... E21B 49/081 166/336
6,029,744 A * 2/2000 Baird ..... E21B 49/083 166/264
(Continued)

FOREIGN PATENT DOCUMENTS

CN 101789191 * 7/2010 ..... G09B 9/00
CN 105507889 * 4/2016 ..... E21B 47/14
(Continued)

OTHER PUBLICATIONS

Li, Sanqing et al., Method of risk assessment for wellbore safety, Western Prospecting Project, 2012, 4 pages.
(Continued)

*Primary Examiner* — Catherine T. Rastovski
*Assistant Examiner* — Sharah Zaab
(74) *Attorney, Agent, or Firm* — PORUS IP LLC

(57) ABSTRACT

Methods and systems for determining a well shut-in pressure of oil and gas well drilling are provided. The method comprises: obtaining, by a first processor, a basic parameter of a target oil and gas well, the basic parameter including at least one of a wellbore structure parameter, a well drilling fluid performance parameter, or a casing string parameter; obtaining, by the first processor, a pressure calculation model; and determining, by the first processor, a maximum well shut-in pressure during well drilling of the target oil and gas well based on the pressure calculation model and the basic parameter.

15 Claims, 4 Drawing Sheets

(51) Int. Cl.
*E21B 47/06* (2012.01)
*E21B 49/08* (2006.01)

(52) U.S. Cl.
CPC ..... *E21B 49/087* (2013.01); *E21B 2200/20* (2020.05); *E21B 2200/22* (2020.05)

(56) References Cited

U.S. PATENT DOCUMENTS

| | | | | |
|---|---|---|---|---|
| 11,203,922 | B1 | 12/2021 | Sun et al. | |
| 2002/0007968 | A1* | 1/2002 | Gardes | E21B 43/00 175/215 |
| 2008/0149343 | A1* | 6/2008 | Chitwood | E21B 36/04 166/360 |
| 2016/0108704 | A1* | 4/2016 | Samuel | E21B 17/00 702/6 |
| 2016/0230547 | A1* | 8/2016 | Lamei | E21B 47/06 |
| 2019/0147125 | A1* | 5/2019 | Yu | E21B 44/00 703/10 |

FOREIGN PATENT DOCUMENTS

| | | | | |
|---|---|---|---|---|
| CN | 106194117 A | | 12/2016 | |
| CN | 106555565 | * | 4/2017 | E21B 33/13 |
| CN | 107327298 A | | 11/2017 | |
| CN | 108561119 | * | 9/2018 | E21B 47/00 |
| CN | 108561119 A | | 9/2018 | |
| CN | 110424954 A | | 11/2019 | |
| CN | 115680584 A | | 2/2023 | |

OTHER PUBLICATIONS

Wang, Weizhi et al., Technology of Well Killing in Carbonate Reservoir in TaHe Oilfield, Western Prospecting Project, 2017, 5 pages.

Zhang, Yingying et al., Analysis of Annular Pressure Generation Mechanism and Research on Safety Evaluation, EDP Sciences, 2021, 5 pages.

* cited by examiner

METHODS AND SYSTEMS FOR DETERMINING WELL SHUT-IN PRESSURES OF OIL AND GAS WELL DRILLING

CROSS-REFERENCE TO RELATED APPLICATION

This application claims priority of Chinese Patent Application No. 202311254721.0, filed on Sep. 27, 2023, the contents of which are entirely incorporated herein by reference.

TECHNICAL FIELD

The present disclosure relates to the technical field of oil and gas development, and in particular, to methods and systems for determining a well shut-in pressure of oil and gas well drilling.

BACKGROUND

With the exploration and development of oil and gas resources, due to complex geological conditions, there are a plurality of sets of pressure systems in a longitudinal direction of a same borehole, resulting in unclear formation rupture pressure laws. Especially for natural gas wells, due to low gas density and easy compression and expansion, a temporary well shut-in pressure is high, and a well shut-in pressure after the well is shut in is also high, which causes a wellhead casing to burst and explode. At the same time, since the natural gas is prone to leakage and overflow with various types and a short occurrence time, it is very easy to cause a serious accident such as a blowout. In particular, when the accident occurs in a sour gas well, life and property safety of on-site staff will be threatened, which makes the handling of an oil and gas well much more difficult and risky.

Therefore, in the process of oil and gas well drilling, in order to safely shut in the well to realize a next step of well killing and to guarantee the safety of well control, one of the keys is to determine a maximum well shut-in pressure. However, there are some problems in the calculation manner used in the engineering at this stage. For a value of the maximum allowable well shut-in pressure is basically determined based on a minimum value of a rated pressure of a wellhead device, 80% of a rated pressure of a casing string, and the formation rupture pressure, without considering the heterogeneity of the casing string and the wear and impact on the casing string due to the mechanical operation and corrosion caused by the high temperature of the high-pressure well, a corrosive gas such as $H_2S$ and $CO_2$, etc., in the process of the casing string being lowered to the well, so that the calculated actual well shut-in capacity value of the casing string is not accurate enough to provide effective reference for the engineering.

Therefore, it is desirable to provide methods and systems for determining a well shut-in pressure of oil and gas well drilling, which can accurately determine and reasonably calculate the maximum well shut-in pressure and ensure the safety of the well shut-in process.

SUMMARY

In view of the problems, one or more embodiments of the present disclosure provide a method for determining a well shut-in pressure of oil and gas well drilling. The method for determining a well shut-in pressure of oil and gas well drilling comprising: obtaining, by a first processor, a basic parameter of a target oil and gas well, the basic parameter including at least one of a wellbore structure parameter, a well drilling fluid performance parameter, or a casing string parameter; obtaining, by the first processor, a pressure calculation model; and determining, by the first processor, a maximum well shut-in pressure during well drilling of the target oil and gas well based on the pressure calculation model and the basic parameter.

In some embodiments, the pressure calculation model is:

$$P_{Cmax} = \min\begin{Bmatrix} P_1 = 0.8(\min\{P_T, P_R\}); \\ P_2 = P_{ba} - P_{be}; \\ P_3 = 0.8(0.0098\rho_f H_f); \end{Bmatrix} \quad (1)$$

where $P_{cmax}$ denotes the maximum well shut-in pressure in MPa; $P_1$ denotes a minimum value of pressure limitation of a wellhead device in MPa; $P_T$ denotes a maximum test pressure of a support casing of the wellhead device in MPa; $P_R$ denotes a rated working pressure of the support casing of the wellhead device in MPa; $P_2$ denotes a minimum value of pressure limitation of the casing string in MPa; $p_{ba}$ denotes a maximum internal pressure strength of the casing string in MPa; $P_{be}$ denotes an effective internal pressure of the casing string in MPa; $P_3$ denotes a minimum value of a formation rupture pressure limitation in MPa; $\rho_f$ denotes a well drilling fluid density in g/cm$^3$; $H_f$ denotes a formation depth (vertical depth) corresponding to a position of a casing shoe in m; $P_{cmax}$, $P_1$, $P_2$, $p_{ba}$, $P_{be}$, and $P_3$ are calculated by the first processor; and $P_T$, $P_R$, $\rho_f$, and $H_f$ are obtained by the first processor from the monitoring device.

In some embodiments, the maximum internal pressure strength of the casing string is calculated by:

$$p_{ba} = p_{ba1} + \Delta p_{ba} \quad (2)$$

$$p_{ba1} = 0.8 \times 2\delta_{ymn}(k_{wall}t_{wall})/D_{out} \quad (3)$$

$$\Delta p_{ba} = 0.2 \times \frac{2k_{dr}\delta_{tmn}(k_{wall}t_{wall} - k_a f_N)}{D_{out} - (k_{wall}t_{wall} - k_a f_N)} \quad (4)$$

where $p_{ba1}$ denotes an internal pressure of the casing string when the casing string satisfies a yield strength in MPa; $\Delta p_{ba}$ denotes a safety margin of an internal pressure strength of the casing string in MPa; $\delta_{ymn}$ denotes a minimum yield strength in MPa; $k_{wall}$ denotes a tolerance factor of a casing string wall without a dimension; $t_{wall}$ denotes a wall thickness of the casing string in mm; $D_{out}$ denotes an outer diameter of the casing string in mm; $k_{dr}$ denotes a correction factor of hardening based on material stress-strain characteristics without a dimension; $\delta_{tmn}$ denotes a minimum tensile strength in MPa; $k_a$ denotes an internal pressure strength factor without a dimension; and $f_N$ denotes a defect depth in mm.

In some embodiments, the correction factor of hardening based on material stress-strain characteristics is calculated by:

$$k_{dr} = (1/2)^{n+1} + (1/\sqrt{3})^{n+1} \quad (5)$$

where n denotes a hardening index without a dimension.

In some embodiments, the effective internal pressure of the casing string is calculated by:

$$P_{be} = P_{bh} - 0.00981\rho_c H \quad (6)$$

$$P_{bh} = 0.00981(a\rho_w + b\rho_g)H \quad (7)$$

where $P_{bh}$ denotes an internal pressure of the casing string of a certain well section and a certain well depth in MPa; $\rho_c$ denotes a formation fluid density in g/cm$^3$; H denotes the well depth in m; a denotes a proportion of a volume of well drilling fluid in a wellbore to a wellbore volume in %; $\rho_w$ denotes the well drilling fluid density in g/cm$^3$; b denotes a proportion of a volume of gas in the wellbore to the wellbore volume in %; and $\rho_g$ denotes a density of gas intruding into the wellbore in g/cm$^3$.

One or more embodiments of the present disclosure provide a system for determining a well shut-in pressure of oil and gas well drilling. The system comprises a first processor. The first processor is configured to obtain a basic parameter of a target oil and gas well, the basic parameter including at least one of a wellbore structure parameter, a well drilling fluid performance parameter, or a casing string parameter, obtain a pressure calculation model, and determine a maximum well shut-in pressure during well drilling of the target oil and gas well based on the pressure calculation model and the basic parameter.

BRIEF DESCRIPTION OF THE DRAWINGS

The present disclosure is further illustrated in terms of exemplary embodiments. These exemplary embodiments are described in detail with reference to the drawings. These embodiments are non-limiting exemplary embodiments, in which like reference numerals represent similar structures, wherein.

DETAILED DESCRIPTION

Figure 1:
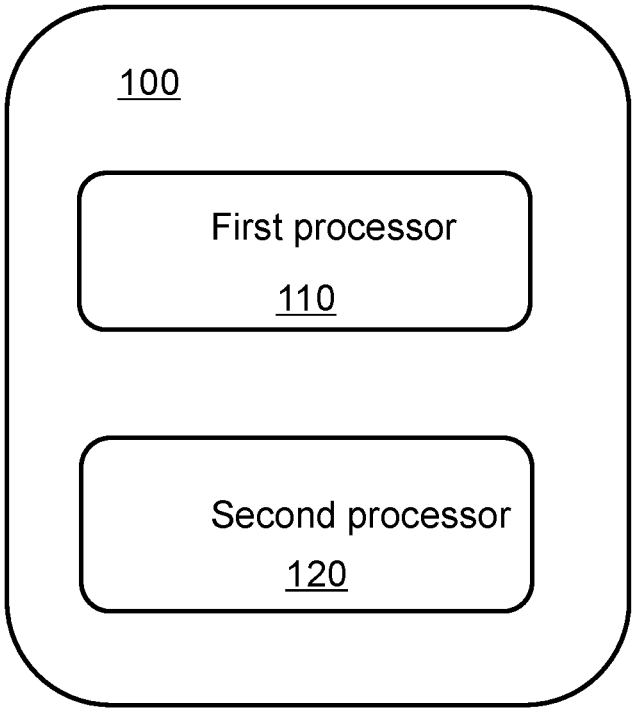
FIG. 1 is a schematic module diagram of a system for determining a well shut-in pressure of oil and gas well drilling according to some embodiments of the present disclosure.

In order to more clearly illustrate the technical solutions related to the embodiments of the present disclosure, a brief introduction of the drawings referred to the description of the embodiments is provided below. Obviously, the drawings described below are only some examples or embodiments of the present disclosure. Those having ordinary skills in the art, without further creative efforts, may apply the present disclosure to other similar scenarios according to these drawings. Unless obviously obtained from the context or the context illustrates otherwise, the same numeral in the drawings refers to the same structure or operation.

It should be understood that the "system," "device," "unit," and/or "module" used herein are one method to distinguish different components, elements, parts, sections, or assemblies of different levels. However, if other words can achieve the same purpose, the words can be replaced by other expressions.

As used in the disclosure and the appended claims, the singular forms "a," "an," and "the" include plural referents unless the content clearly dictates otherwise; the plural forms may be intended to include singular forms as well. In general, the terms "comprise," "comprises," and/or "comprising," "include," "includes," and/or "including," merely prompt to include steps and elements that have been clearly identified, and these steps and elements do not constitute an exclusive listing.

The flowcharts used in the present disclosure illustrate operations that the system implements according to the embodiment of the present disclosure. It should be understood that the foregoing or following operations may not necessarily be performed exactly in order. Instead, the operations may be processed in reverse order or simultaneously. Besides, one or more other operations may be added to these processes, or one or more operations may be removed from these processes.

The present disclosure is further described below in connection with embodiments. It should be noted that the embodiments and the technical features in the embodiments in the present disclosure may be combined with each other without conflict. It is to be noted that, unless otherwise indicated, all technical and scientific terms used in the present disclosure have the same meanings as those commonly understood by those skilled in the art to which the present disclosure belongs. In the present disclosure, the terms "comprise," "comprises," and/or "comprising," "include," "includes," and/or "including," or any other variation thereof are intended to mean that the elements or articles appearing before the word cover the elements or articles listed after the word and their equivalents, and do not exclude other elements or articles.

FIG. 1 is an exemplary module diagram of a system for determining a well shut-in pressure of oil and gas well drilling according to some embodiments of the present disclosure.

In some embodiments, the system 100 for determining a well shut-in pressure of oil and gas well drilling may include a first processor 110 and a second processor 120.

The first processor 110 refers to a processor used to process data and/or information obtained from components of other mechanisms of the system for determining a well shut-in pressure of oil and gas well drilling and completing main calculations. The first processor has sufficient computing power and is responsible for completing complex calculations, such as most of the calculations of the entire system for determining a well shut-in pressure of oil and gas well drilling or preliminary training of a parameter recommendation model.

In some embodiments, the first processor 110 may be located at a remote device. The remote device refers to a device that is capable of remote computation and has sufficient computing power, for example, a remote server.

In some embodiments, the first processor 110 may obtain data from a monitoring device.

The monitoring device refers to a device used to monitor various parameters of a target oil and gas well. The various parameters may include a basic parameter of the target oil and gas well, a wellhead pressure, a bottomhole pressure, etc. More descriptions regarding the basic parameter may be found in relevant descriptions of FIG. 2. For example, the monitoring device may include a pressure monitoring device (e.g., a pressure meter or a sensor), a density detection device, a depth detection device, a length measurement device, etc.

In some embodiments, the first processor 110 is configured to obtain basic parameter of the target oil and gas well. In some embodiments, the basic parameter includes at least one of a wellbore structure parameter, a well drilling fluid performance parameter, or a casing string parameter.

In some embodiments, the first processor 110 is further configured to obtain a pressure calculation model.

In some embodiments, the pressure calculation model is:

$$P_{Cmax} = \min\begin{Bmatrix} P_1 = 0.8(\min\{P_T, P_R\}); \\ P_2 = P_{ba} - P_{be}; \\ P_3 = 0.8(0.0098\rho_f H_f); \end{Bmatrix}$$

where $P_{cmax}$ denotes the maximum well shut-in pressure in MPa; $P_1$ denotes a minimum value of pressure limitation of a wellhead device in MPa; $P_T$ denotes a maximum test pressure of a support casing of the wellhead device in MPa; $P_R$ denotes a rated working pressure of the support casing of the wellhead device in MPa; $P_2$ denotes a minimum value of pressure limitation of the casing string in MPa; $p_{ba}$ denotes a maximum internal pressure strength of the casing string in MPa; $P_{be}$ denotes an effective internal pressure of the casing string in MPa; $P_3$ denotes a minimum value of a formation rupture pressure limitation in MPa; $\rho_f$ denotes a well drilling fluid density in g/cm$^3$; $H_f$ denotes a formation depth (vertical depth) corresponding to a position of a casing shoe in m; $P_{cmax}$, $P_1$, $P_2$, $p_{ba}$, $P_{be}$, and $P_3$ are calculated by the first processor; $P_T$, $P_R$, $\rho_f$, and $H_f$ are obtained by the first processor from the monitoring device.

In some embodiments, the first processor 110 determines a maximum well shut-in pressure during well drilling of the target oil and gas well based on the pressure calculation model and the basic parameter.

In some embodiments, the first processor 110 determines a recommended monitoring parameter and a recommended well drilling parameter based on the maximum well shut-in pressure and based on a wellhead pressure sequence and a bottomhole pressure sequence in a preset time period collected by the monitoring device.

In some embodiments, the first processor 110 generates a monitoring adjustment instruction based on the recommended monitoring parameter and sends the monitoring adjustment instruction to the monitoring device.

In some embodiments, the first processor 110 generates a well drilling operation instruction based on the recommended well drilling parameter and sends the well drilling operation instruction to a second processor 120.

In some embodiments, the recommended well drilling parameter includes a recommended well shut-in time. The first processor is further configured to obtain a parameter recommendation model based on preliminary training and predict the recommended well shut-in time by processing the maximum well shut-in pressure, the wellhead pressure sequence, and the bottomhole pressure sequence based on the parameter recommendation model. The parameter recommendation model is a machine learning model.

In some embodiments, the parameter recommendation model includes a sequence feature extraction layer and a prediction layer. In some embodiments, an input of the sequence feature extraction layer includes the wellhead pressure sequence and the bottomhole pressure sequence, and an output of the sequence feature extraction layer includes a fused sequence feature. In some embodiments, an input of the prediction layer includes the fused sequence feature and the maximum well shut-in pressure, and an output of the prediction layer includes the recommended well shut-in time. In some embodiments, the sequence feature extraction layer and the prediction layer are obtained through joint training.

In some embodiments, in response to receiving a feedback signal from the monitoring device and/or a well drilling operation device, the first processor 110 sends an update instruction to the second processor.

The second processor refers to a processor that obtains data and/or information from components of other mechanisms of the system for determining a well shut-in pressure of oil and gas well drilling and completes edge calculations. The second processor that completes the edge calculations has low data latency, short response time, and greater real-time availability of a data computation result.

In some embodiments, the second processor 120 may be located at a terminal device. The terminal device refers to a device capable of performing edge calculations. In some embodiments, the terminal device may be a device integrated with the monitoring device or may be a separate device.

In some embodiments, there may be a plurality of second processors 120 and there is an one-to-one correspondence between the plurality of second processors 120 and wells.

In some embodiments, the second processor 120 may obtain data from the monitoring device.

In some embodiments, the second processor is configured to obtain, in response to receiving the update instruction, an updated wellhead pressure sequence and an updated bottomhole pressure sequence from the monitoring device, process the updated wellhead pressure sequence and the updated bottomhole pressure sequence, and determines an updated recommended well shut-in time based on the parameter recommendation model obtained from the first processor.

In some embodiments, different oil and gas wells correspond to different terminal devices, and different second processors and different monitoring devices corresponding to the different oil and gas wells are disposed in the different terminal devices.

In some embodiments, the second processors of the different terminal devices perform enhanced training on the parameter recommendation model based on well drilling feature information of the oil and gas wells corresponding to the different terminal devices.

In some embodiments, the second processor 120 is further configured to obtain actual well drilling data of the corresponding oil and gas wells from a storage device as a training sample of the enhanced training. The second processor 120 is further configured to obtain a predicted value by inputting the training sample into the parameter recommendation model obtained by the first processor. The second processor 120 is further configured to determine a difference value based on the predicted value and a labeled value of the training sample and send the difference value to the first processor 110. The second processor 120 is further configured to construct a first loss function based on the difference values and updating the parameter recommendation model of the second processor based on the first loss function. The first processor 110 is further configured to generate a fused difference value by fusing the different difference values obtained from the different second processors. The first processor 110 is further configured to construct a second loss function based on the fused difference value and update the parameter recommendation model of the first processor based on the second loss function.

In some embodiments, the system 100 for determining a well shut-in pressure of oil and gas well drilling may further include a storage device. The storage device may be used to store data and/or instructions related to the system for determining a well shut-in pressure of oil and gas well drilling.

Figure 2:
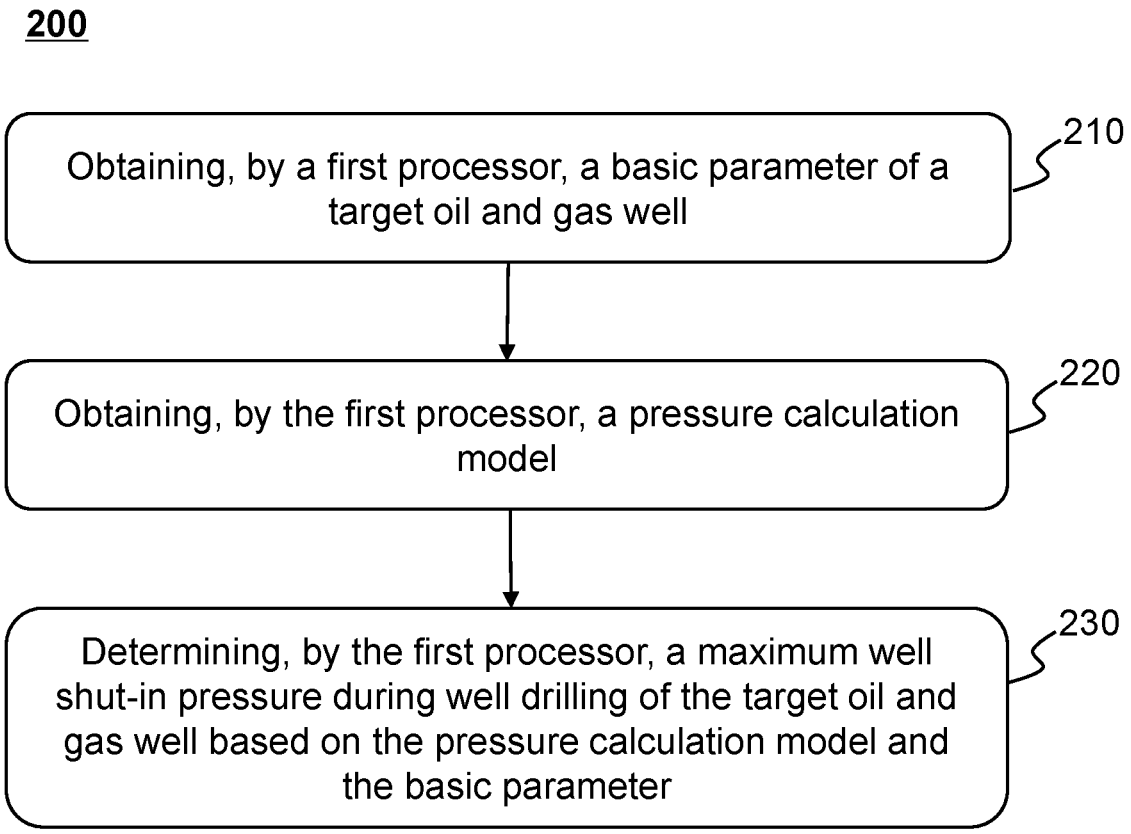
FIG. 2 is an exemplary flowchart of a process for determining a well shut-in pressure of oil and gas well drilling according to some embodiments of the present disclosure.
Figure 3:
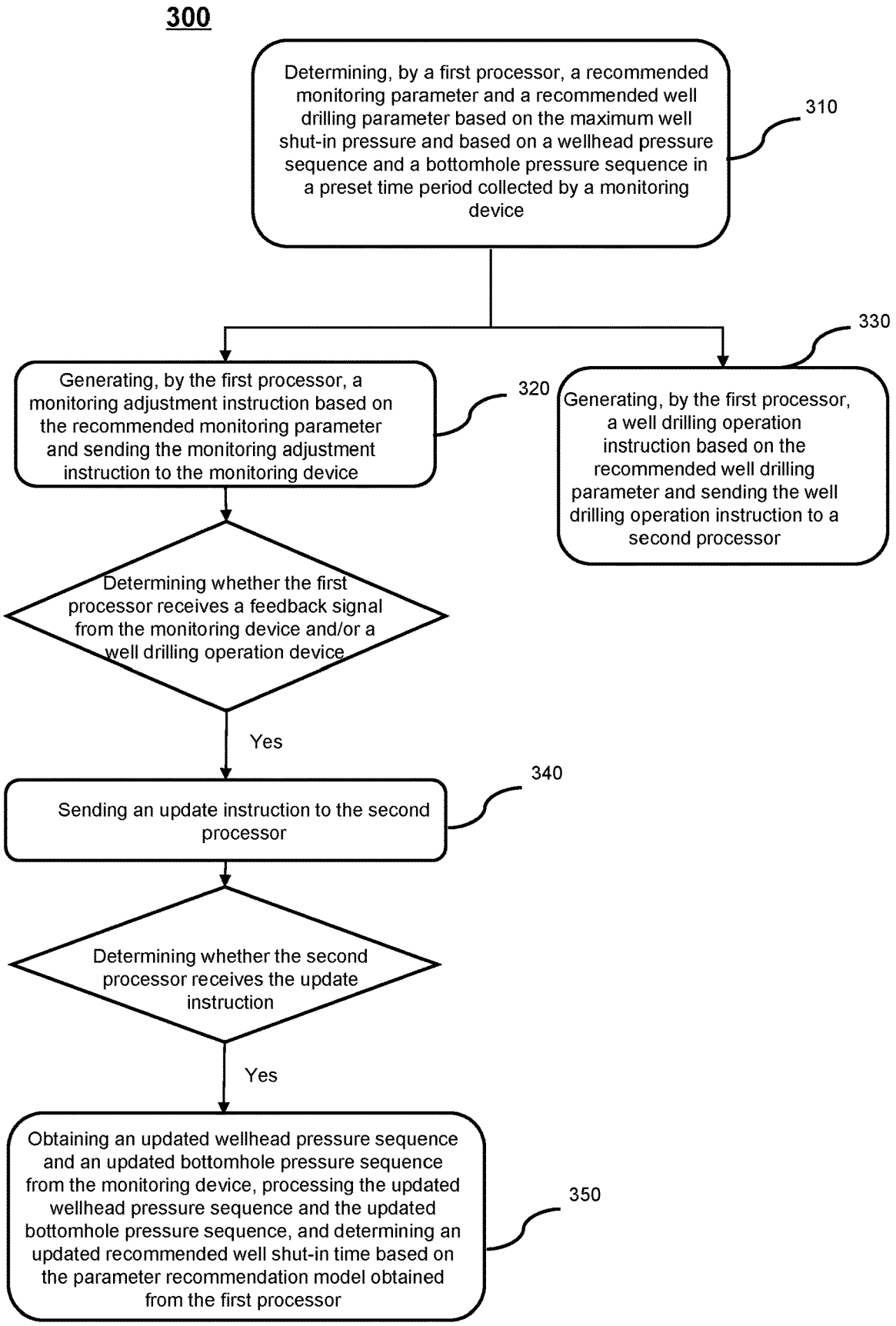
FIG. 3 is an exemplary flowchart of a process for determining an updated recommended well shut-in time according to some embodiments of the present disclosure.
Figure 4:
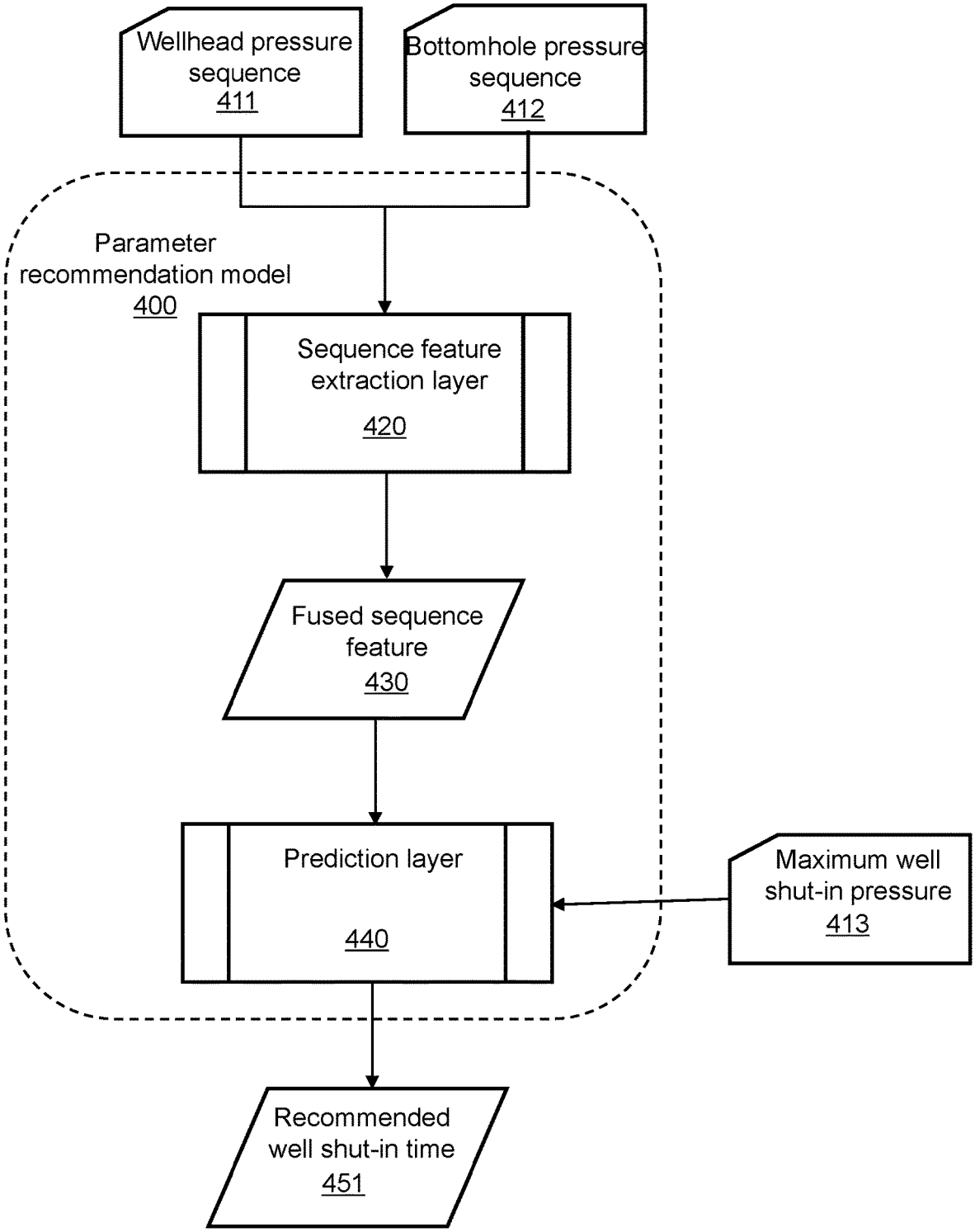
FIG. 4 is a schematic diagram of a parameter recommendation model according to some embodiments of the present disclosure.

More descriptions regarding the first processor 110 and the second processor 120 may be found in FIGS. 2-4 and the related descriptions thereof.

In some embodiments of the present disclosure, the first processor having the sufficient computing power and located in the remote device obtains the data from the monitoring device and completes the complex calculations, such as most of the calculations in the method for determining the well shut-in pressure of oil and gas well drilling and the preliminary training of the parameter recommendation model, and the second processor located in the terminal device completes the edge calculations, so as to improve the accuracy, real-time performance, and efficiency of the calculations of determining the recommended well shut-in time.

It is to be noted that the above description of the system for determining a well shut-in pressure of oil and gas well drilling and modules thereof is provided only for convenience of illustration, and does not limit the present disclosure to the scope of the cited embodiments. It is understood that for those skilled in the art, after understanding the principle of the system, it may be possible to arbitrarily combine the modules to form a sub-system to connect with other modules without deviating from the principle. In some embodiments, the first processor and the second processor disclosed in FIG. 1 may be different modules in a single system, or one single module that implements the functions of two or more of the modules. For example, each module may share one storage module, or each module may have its own storage module. Such deformations are within the scope of protection of the present disclosure.

FIG. 2 is an exemplary flowchart of a process of a method for determining a well shut-in pressure of oil and gas well drilling according to some embodiments of the present disclosure. In some embodiments, process 200 may be performed by the first processor 110 of the system 100 for determining a well shut-in pressure of oil and gas well drilling. As shown in FIG. 2, process 200 includes operations 210-230 as follows.

In 210, the first processor obtains a basic parameter of a target oil and gas well.

The target oil and gas well refers to an oil and gas well that is undergoing a well drilling operation and requires a prediction of a maximum well shut-in pressure.

The basic parameter refers to a parameter related to the target oil and gas well.

In some embodiments, the basic parameter includes at least one of a wellbore structure parameter, a well drilling fluid performance parameter, or a casing string parameter.

The wellbore structure parameter refers to a parameter related to a structure of the oil and gas well. For example, the wellbore structural parameter may include a drill bit size, a borehole diameter, a well depth, a casing depth, a cement return height, or the like, or any combination thereof.

In some embodiments, the first processor may obtain the wellbore structure parameter from the storage device and/or a length measurement device (e.g., a length sensor). The wellbore structure parameter of the target oil and gas well in the storage device.

The well drilling fluid performance parameter refers to a parameter that may reflect performance of a well drilling fluid. For example, the well drilling fluid performance parameter may include the well drilling fluid density, a well drilling fluid pressure gradient, a formation fluid density, an intrusive gas density, or the like, or any combination thereof.

In some embodiments, the first processor may obtain the well drilling fluid performance parameter from a storage device, a pressure detection device (e.g., a pressure sensor), a density detection device (e.g., a density sensor), or the like, or any combination thereof.

A casing string refers to a type of long steel pipe used to construct the oil and gas well. The casing string may include a conduit, a surface casing, a technical casing, a tail pipe, etc.

The casing string parameter refers to a parameter related to the casing string. In some embodiments, the casing string parameter may include a grade (e.g., steel grade), an outer diameter, a wall thickness, a hardening coefficient, an internal pressure strength factor of the casing string, a tolerance factor of a casing string wall, or the like, or any combination thereof. More descriptions regarding the hardening coefficient, the internal pressure strength factor, and the tolerance factor of the casing string wall may be found below.

In some embodiments, the first processor may obtain the casing string parameter from the storage device and/or the length measurement device (e.g., the length sensor).

More descriptions regarding the first processor may be found in related descriptions of FIG. 1.

In 220, the first processor obtains a pressure calculation model.

The pressure calculation model refers to a model used to calculate the maximum well shut-in pressure of the oil or gas well during well drilling.

In some embodiments of the present disclosure, the pressure calculation model may be:

$$P_{Cmax} = \min\begin{Bmatrix} P_1 = 0.8(\min\{P_T, P_R\}); \\ P_2 = P_{ba} - P_{be}; \\ P_3 = 0.8(0.0098\rho_f H_f); \end{Bmatrix} \quad (1)$$

where $P_{cmax}$ denotes the maximum well shut-in pressure in MPa; $P_1$ denotes a minimum value of pressure limitation of a wellhead device in MPa; $P_T$ denotes a maximum test pressure of a support casing of the wellhead device in MPa; $P_R$ denotes a rated working pressure of the support casing of the wellhead device in MPa; $P_2$ denotes a minimum value of pressure limitation of the casing string in MPa; $p_{ba}$ denotes a maximum internal pressure strength of the casing string in MPa; $P_{be}$ denotes an effective internal pressure of the casing string in MPa; $P_3$ denotes a minimum value of a formation rupture pressure limitation in MPa; $\rho_f$ denotes a well drilling fluid density in g/cm$^3$; $H_f$ denotes a formation depth (vertical depth) corresponding to a position of a casing shoe in m; $P_{cmax}$, $P_1$, $P_2$, $p_{ba}$, $P_{be}$, and $P_3$ are calculated by the first processor; and $P_T$, $P_R$, $\rho_f$, and $H_f$ are obtained by the first processor from the monitoring device.

The maximum well shut-in pressure refers to a maximum pressure threshold that may be carried by a wellhead or well of the target oil and gas well.

The wellhead device refers to equipment located at the wellhead of the target oil and gas well. The wellhead device may include a casing head, a tubing head, and an oil (gas) production tree.

The minimum value of pressure limitation of the wellhead device refers to a minimum value of a maximum bearing pressure corresponding to each wellhead device.

The maximum test pressure of a support casing of the wellhead device refers to a maximum value of the test pressure corresponding to the support casing of each wellhead device.

The rated working pressure of the support casing of the wellhead device refers to a maximum allowable working pressure calibrated when the support casing of the wellhead device leaves the factory.

The minimum value of pressure limitation of the casing string refers to a minimum value of a maximum bearing pressure corresponding to each casing string.

The maximum internal pressure strength of the casing string refers to a maximum pressure strength that may be borne by the interior of the casing string.

The effective internal pressure of the casing string refers to an air pressure inside the casing string.

The minimum value of a formation rupture pressure limitation refers to a minimum value of a maximum pressure that may be borne when fracturing and cracking occurs in the formation at each depth.

The formation depth corresponding to a position of a casing shoe refers to a vertical depth of the position of the casing shoe from the wellhead.

In some embodiments, the first processor may obtain $P_{cmax}$, $P_1$, $P_2$, $p_{ba}$, $P_{be}$, and $P_3$ by calculating. For example, the first processor may determine $P_{cmax}$, $P_1$, $P_2$, $p_{ba}$, $P_{be}$, and $P_3$ by calculating through recognized physical experiments or equations specified in the present disclosure.

In some embodiments, the first processor may obtain $P_T$, $P_R$, $\rho_f$, and $H_f$ from the monitoring device. More descriptions regarding the monitoring device may be found in the related descriptions of FIG. 1.

In some embodiments, the maximum internal pressure strength of the casing string may be calculated by the following equation.

$$P_{ba} = P_{ba1} + \Delta p_{ba} \tag{2}$$

$$p_{ba1} = 0.8 \times 2\delta_{ymn}(k_{wall}t_{wall})/D_{out} \tag{3}$$

$$\Delta p_{ba} = 0.2 \times \frac{2k_{dr}\delta_{tmn}(k_{wall}t_{wall} - k_a f_N)}{D_{out} - (k_{wall}t_{wall} - k_a f_N)} \tag{4}$$

where $p_{ba1}$ denotes an internal pressure of the casing string when the casing string satisfies a yield strength in MPa; $\Delta p_{ba}$ denotes a safety margin of an internal pressure strength of the casing string in MPa; $\delta_{ymn}$ denotes a minimum yield strength in MPa; $k_{wall}$ denotes a tolerance factor of a casing string wall without a dimension; $t_{wall}$ denotes a wall thickness of the casing string in mm; $D_{out}$ denotes an outer diameter of the casing string in mm; $k_{dr}$ denotes a correction factor of hardening based on material stress-strain characteristics without a dimension; $\delta_{tmn}$ denotes a minimum tensile strength in MPa; $k_a$ denotes an internal pressure strength factor without a dimension; and $f_N$ denotes a defect depth in mm.

The internal pressure of the casing string when the casing string satisfies a yield strength refers to an internal pressure of the casing string when the casing string satisfies the yield strength.

The yield strength refers to a minimum value of stress at which the casing string begins to undergo significant plastic deformation. The minimum yield strength refers to a minimum value among yield strengths corresponding to all casing strings. The safety margin of an internal pressure strength of the casing string refers to a residual value between the internal pressure strength of the casing string when the casing string satisfies the yield strength and an actual internal pressure strength of the casing string.

The tolerance factor of the casing string wall refers to a specification value of a steel used in the casing string. For example, the tolerance factor of the casing string wall specified in the ASME SA-530/SA-530M standard.

A tensile strength characterizes a maximum ability of the casing string to resist damage under tensile force. The minimum tensile strength refers to a minimum value among tensile strengths corresponding to all casing strings.

The correction factor of hardening based on material stress-strain characteristics may be a numerical factor introduced to eliminate errors in the hardening of the material stress-strain characteristics obtained from measurement.

The internal pressure strength factor characterizes a strength distribution of a stress field at a crack tip on an inner wall of the casing string under external force.

The defect depth refers to a depth of a defect (e.g., a crack or an inclusion) in the material of the casing string in which the defect is located.

In some embodiments, the first processor may obtain the safety margin of the internal pressure strength of the casing string, the minimum yield strength, the minimum tensile strength, the correction factor of hardening, and the internal pressure strength factor by calculating. For example, the first processor may determine the safety margin of the internal pressure strength of the casing string, the minimum yield strength, the minimum tensile strength, the correction factor of hardening, and the internal pressure strength factor by calculating through recognized physical experiments or equations specified in the present disclosure.

In some embodiments, the first processor may obtain the wall thickness of the casing string, the outer diameter of the casing string, and the defect depth from the monitoring device.

In the process of the casing string being lowered to the target oil and gas well, the casing string may be subject to wear and impact due to a mechanical operation and corrosion caused by a high temperature of a high-pressure gas well and a corrosive gas such as $H_2S$ and $CO_2$. At the same time, a size of the casing string that is lowered to the target oil and gas well may be a non-standard size, which is larger than a size of the existing casing string. Therefore, in order to ensure the accuracy of the maximum internal pressure strength of the casing string obtained by calculating, it is necessary to determine the wall thickness of the casing string and the outer diameter of the casing string after the casing string is lowered to the target oil and gas well instead of measuring the wall thickness of the casing string and the outer diameter of the casing string in advance.

In some embodiments, after the casing string is lowered to the target oil and gas well, the first processor may calculate and determine the wall thickness of the casing string based on measured values of wall thicknesses of the casing string at a plurality of positions, and the first processor may determine and calculate the outer diameter of the casing string based on measured values of outer diameters of the casing string at the plurality of positions.

In some embodiments, the measured values of wall thicknesses of the casing string and the measured values of outer diameters of the casing string may be obtained by a logging device and transmitted to the first processor.

The logging device may be used to measure the wall thickness of the casing string and the outer diameter of the casing string. The logging device may include an electronic logging instrument, etc.

In some embodiments, the first processor may randomly determine the plurality of positions.

In some embodiments, the first processor may also determine the plurality of positions based on an appearance feature of the casing string and an order in which the casing string is lowered to the well.

The appearance feature of the casing string refers to a feature related to the appearance of the casing string. The appearance feature of the casing string may include at least one of a length of the casing string, a special position of the appearance of the casing string, etc. The special position of the appearance of the casing string refers to a position of the casing string that is susceptible to wear and tear in the process of lowering the casing string into the target oil and gas well. For example, connection points between casing strings, deformation points of the casing strings, and damage points of the casing strings before being lowered to the target oil and gas wells.

In some embodiments, the first processor may determine the appearance feature of the casing string based on scanning data of the casing string. The scanning data refers to data obtained by scanning the appearance of the casing string. For example, the first processor may obtain a three dimensional (3D) model of the casing string by performing, based on the scanning data of the casing string, 3D modeling, identify the special position of the appearance of the casing string automatically based on the 3D model through a preset algorithm, and determine the special position of the appearance of the casing string as the appearance feature of the casing string. The preset algorithm may include a segmentation algorithm, a feature extraction algorithm, or the like, or any combination thereof.

The order in which the casing string is lowered to the well refers to an order in which at least one casing string is installed and arranged in the target oil and gas well. The order in which the casing string is lowered to the well may be used to determine information about a position of the casing string in the target oil and gas well. For example, if the order of a certain casing string is third from the bottom of the target oil and gas well, the first processor may determine information about the position of the casing string in the target oil and gas well based on a length of all casing strings installed in the target oil and gas well and the order in which the casing string is installed and arranged.

In some embodiments, the first processor may determine position information (e.g., a few meters below the target oil and gas well) of a plurality of special positions of the appearance of the casing string based on the appearance feature of the casing string and the order in which the casing string is lowered to the well as a plurality of positions to be measured.

In some embodiments, the first processor may also randomly assign the plurality of positions to be measured.

In some embodiments, the logging device may complete monitoring based on the determined plurality of positions to be measured and obtain the measured values of wall thicknesses of the casing string and the measured values of outer diameters of the casing string at the plurality of positions.

In some embodiments, the first processor may take an average or a minimum of the measured values of wall thicknesses of the casing string at the plurality of positions and determine the average or the minimum as the wall thickness of the casing string.

In some embodiments, the first processor may take an average or a minimum of the measured values of outer diameters of the casing string at the plurality of positions and determine the average or the minimum as the outer diameter of the casing string.

In some embodiments of the present disclosure, the wall thickness of the casing string and the outer diameter of the casing string are determined after the casing string is lowered to the target oil and gas well, i.e., after various factors affect the wall thickness of the casing string and the outer diameter of the casing string, which ensures the accuracy of the measured wall thickness of the casing string and outer diameter of the casing string, thereby ensuring the accuracy of the calculated maximum internal pressure strength of the casing string.

Additionally, in the process of calculating the wall thickness of the casing string and the outer diameter of the casing string, the wall thickness of the casing string and the outer diameter of the casing string are determined based on the measured values of wall thicknesses of the casing string and the measured values of outer diameters of the casing string at the plurality of position, which avoids the influence of accidental factors on the calculation result and further ensures the accuracy of the finally calculated wall thickness of the casing string and outer diameter of the casing string, thereby ensuring the accuracy of the calculated maximum internal pressure strength of the casing string.

In some embodiments, the correction factor of hardening based on material stress-strain characteristics may be calculated by the following equation.

$$k_{dr} = (1/2)^{n+1} + (1/\sqrt{3})^{n+1} \tag{5}$$

where n denotes a hardening index without a dimension.

In one specific embodiment, the hardening index is calculated from a true stress-strain curve tested by a uniaxial tensile test. For the casing string made of quenching and tempering of martensitic steel or 13Cr products, a value of the internal pressure strength factor is 1.0. For the casing string made of normalized steel, the value of the internal pressure strength factor is 2.0. If the heat treatment state of the casing string is not known, the value of the internal pressure strength factor is 2.0.

Because of the heterogeneity of the casing string and the wear and impact due to the mechanical operation and corrosion caused by the high temperature of the high-pressure gas well, the corrosive gas such as $H_2S$ and $CO_2$ in the process of lowering, it is necessary to take into account the influence of the material and the wall thickness.

In the existing calculation manner, there are problems as follows.

(1) Minimum yield strength and ultimate tensile strength determined by the material of the casing string Commonly used surface casing strings J55 and K55 have the hardening coefficient of 0.12 and the minimum yield strength of 379 MPa. Due to the relatively conservative value of the yield strength, the internal pressure strength of the casing string is reduced.

(2) Size of the casing string—outer diameter and wall thickness of the casing string Because sizes of some oil and gas wells casing string are non-standard sizes, which are larger than the size of the existing casing string, the internal pressure strength of the casing string is lower than that of the casing string used in an actual field.

(3) The hardening factor of the material of the casing string and the internal pressure strength factor are not considered, which reduces the internal pressure strength of the casing string.

(4) A difference between the formation fluid density and the well drilling fluid density and a pressure difference caused by the difference are not considered.

In the embodiments, the calculation model of the internal pressure strength of the casing adopted in the present disclosure takes into account the manufacturing defects such as ellipticity, eccentricity, manufacturing cracks, and the degree of certainty of crack detection, etc., that are potentially present in the manufacturing manner, the heat treatment, and the manufacturing process of the casing string and considers the strength, toughness, and plasticity of the casing string material. In addition to the yield strength, the tolerance factor of the wall, the defect depth, the wall thickness, and the outer diameter of the casing string, the calculation conditions such as the internal pressure strength factor and the hardening index are also introduced, which may make the maximum internal pressure strength of the casing string obtained by calculating in the present disclosure more in line with the actual engineering, so that the maximum well shut-in pressure value may be calculated more accurately.

In some embodiments, the effective internal pressure of the casing string is calculated by the following equation.

$$P_{be} = P_{bh} - 0.00981\rho_c H \tag{6}$$

$$P_{bh} = 0.00981(a\rho_w + b\rho_g)H \tag{7}$$

where $P_{bh}$ denotes an internal pressure of the casing string of a certain well section and a certain well depth in MPa; $\rho_c$ denotes a formation fluid density in g/cm$^3$; H denotes the well depth in m; a denotes a proportion of a volume of well drilling fluid in a wellbore to a wellbore volume in %; $\rho_w$ denotes the well drilling fluid density in g/cm$^3$; b denotes a proportion of a volume of gas in the wellbore to the wellbore volume in %; and $\rho_g$ denotes a density of gas intruding into the wellbore in g/cm$^3$.

In 230, the first processor determines a maximum well shut-in pressure during well drilling of the target oil and gas well based on the pressure calculation model and the basic parameter.

In some embodiments, the first processor may input the basic parameter into the pressure calculation model, and a maximum well shut-in pressure output by the pressure calculation model is determined to be the maximum well shut-in pressure during well drilling of the target oil and gas well. More descriptions regarding the pressure calculation model may be found in the related descriptions of the operation 220.

Since the maximum well shut-in pressure is a safety threshold of a pressure that may be carried by the wellhead or the well, there is a potential safety hazard if an actual well shut-in pressure exceeds the maximum well shut-in pressure. However, the actual well shut-in pressure may only be measured after the well is shut in. Therefore, the first processor may obtain the maximum well shut-in pressure by calculating before the well is shut in through the pressure calculation model and predict a recommended well shut-in time, and the well is shut in according to the recommended well shut-in time to ensure that there is no abnormality in the subsequent well shut-in.

Additionally, the first processor may compare the maximum well shut-in pressure obtained by the calculating with the actual well shut-in pressure obtained based on the monitoring device. When the actual well shut-in pressure is greater than the maximum well shut-in pressure, the first processor may carry out a warning to notify the staff to take certain measures to relieve the actual well shut-in pressure of the target oil and gas well, so that the actual well shut-in pressure is smaller than the maximum well shut-in pressure, so as to ensure that there is no abnormality in the subsequent well shut-in In one specific embodiment, taking a certain ultra-deep natural gas well in Gaoshi in the Sichuan-Chongqing region as an example, the maximum well shut-in pressure is calculated using the method for determining a well shut-in pressure of oil and gas well drilling.

In this embodiment, the casing string size and rated internal pressure strength of the wellbore structure data during a second development at an overflow place of the well are used as the basis for calculation. When the overflow occurs, the gas arrives at the wellhead. At this time, the gas accounts for 13% of a wellbore cross-sectional area. The basic parameter of the target well is shown in Table 1.

TABLE 1

| Basic parameter of target well | | | | | |
|---|---|---|---|---|---|
| Wellbore structure | | | | | |
| Number of development | Drill size (mm) | Borehole diameter (mm) | Well depth (m) | Casing depth (m) | Cement return height (m) |
| second development | 311.2 | 311.2 | 2352 | 2349.75 | 0 |
| Well drilling fluid performance | | | | | |
| Well drilling fluid density (g/cm$^3$) | Well drilling fluid pressure gradient (kPa/m) | Formation fluid density (g/cm$^3$) | Intrusive gas density (g/cm$^3$) | | |
| 1.75 | 10.5 | 1.05 | 0.77 | | |
| Casing string parameter | | | | | |
| Grade (steel grade) | Outer diameter (mm) | Wall thickness (mm) | Hardening coefficient | Internal pressure strength factor | Tolerance factor of the casing string wall |
| TP110TS | 244.5 | 11.9 | 0.08 | 1.0 | 0.875 |

Considering factors such as well wall stability, well depth, and casing strength, the result of the maximum well shut-in pressure obtained by calculating using the calculation model of the maximum well shut-in pressure during well drilling of the oil and gas well is shown in Table 2.

TABLE 2

| Result of maximum well shut-in pressure of the target oil and gas well obtained using the calculation model in the present disclosure | | | | |
|---|---|---|---|---|
| Calculation result of the maximum internal pressure strength of the casing string | | | | |
| Yield strength (MPa) | Tensile strength (MPa) | Yield internal pressure (MPa) | Safety margin (MPa) | Maximum internal pressure strength of the casing string (MPa) |
| 758 | 862 | 51.65 | 14.16 | 65.66 |
| Calculation result of the maximum well shut-in pressure | | | | |
| Effective internal pressure of the casing string (MPa) | Maximum well shut-in pressure (MPa) | Actual well shut-in pressure (MPa) | Error analysis | |
| 0.55 | 65.11 | 68 | 4.25% | |

The result of the maximum well shut-in pressure obtained using a conventional calculation model of the maximum well shut-in pressure (determined by a minimum value of the rated pressure of the wellhead device, 80% of the rated pressure of the casing string, and the formation rupture pressure) is shown in Table 3.

TABLE 3

| Result of maximum well shut-in pressure of target oil and gas well obtained using conventional model | | | |
|---|---|---|---|
| Internal pressure strength of the casing string of second development (MPa) | Maximum allowable well shut-in pressure (MPa) | Actual well shut-in pressure (MPa) | Error analysis |
| 65 | 52 | 68 | 23.53% |

Comparing the calculation results in Table 2 and Table 3, it may be found that the error between the maximum well shut-in pressure obtained in the present disclosure and the actual well shut-in pressure is only 4.25%, which is smaller than 5%, and the error between the maximum well shut-in pressure obtained by the traditional model and the actual well shut-in pressure is as high as 23.53%, which is greater than 20%. The accuracy of the calculation result of the present disclosure is 19.28% higher than that of the traditional model, which is a significant improvement. The calculation result of the present disclosure is more in line with the actual working conditions.

In another specific embodiment, taking a certain ultra-deep natural gas well in Shuangyu in the Sichuan-Chongqing region as an example, the maximum well shut-in pressure is calculated using the method for determining a maximum well shut-in pressure of well drilling of the oil and gas well.

In this embodiment, the casing string size and rated internal pressure strength of the wellbore structure data during a third development at an overflow place of the well are used as the basis for calculation. When the overflow occurs, the gas arrives at the wellhead. At this time, the gas accounts for 10.07% of the wellbore cross-sectional area. The basic parameter of the target well is shown in Table 4.

TABLE 4

| Basic parameter of target oil and gas well | | | | | |
|---|---|---|---|---|---|
| Wellbore structure | | | | | |
| Number of development | Drill size (mm) | Borehole diameter (mm) | Well depth (m) | Casing depth (m) | Cement return height (m) |
| third development | 333.4 | 333.4 | 3698 | 3696.13 | 0 |
| Well drilling fluid performance | | | | | |
| Well drilling fluid density ($g/cm^3$) | Well drilling fluid pressure gradient (kPa/m) | Formation fluid density ($g/cm^3$) | Intrusive gas density ($g/cm^3$) | | |
| 1.68 | 10.5 | 1.05 | 0.738 | | |
| Casing string parameter | | | | | |
| Grade (steel grade) | Outer diameter (mm) | Wall thickness (mm) | Hardening coefficient | Internal pressure strength factor | Tolerance factor of the casing string wall |
| TP110TS | 273.05 | 13.84 | 0.08 | 1.0 | 0.875 |

Considering the factors such as well wall stability, well depth, and casing strength, the result of the maximum well shut-in pressure obtained using the pressure calculation model in the method for determining a well shut-in pressure of oil and gas well drilling in the present disclosure is shown in Table 5.

TABLE 5

| Result of maximum well shut-in pressure of the target oil and gas well obtained using the calculation model in the present disclosure | | | | |
|---|---|---|---|---|
| Calculation result of the maximum internal pressure strength of the casing string | | | | |
| Yield strength (MPa) | Tensile strength (MPa) | Yield internal pressure (MPa) | Safety margin (MPa) | Maximum internal pressure strength of the casing string (MPa) |
| 758 | 862 | 53.79 | 15.0 | 68.79 |
| Calculation result of the maximum well shut-in pressure | | | | |
| Effective internal pressure of the casing string (MPa) | Maximum well shut-in pressure (MPa) | Actual well shut-in pressure (MPa) | Error analysis | |
| 6.28 | 62.51 | 62.9 | 0.62% | |

The result of the maximum well shut-in pressure obtained using the conventional calculation model of the maximum well shut-in pressure (determined by the minimum value of the rated pressure of the wellhead device, 80% of the rated pressure of the casing string, and the formation rupture pressure) is shown in Table 6.

TABLE 6

| Result of maximum well shut-in pressure of the target oil and gas well obtained using the conventional model | | | |
|---|---|---|---|
| Internal pressure strength of the casing string of third development (MPa) | Maximum allowable well shut-in pressure (MPa) | Actual well shut-in pressure (MPa) | Error analysis |
| 67 | 53.6 | 62.9 | 14.79% |

Comparing the calculation results in Table 5 and Table 6, it may be found that the error between the maximum well shut-in pressure obtained in the present disclosure and the actual well shut-in pressure is only 0.62%, which is smaller than 1%, and the error between the maximum well shut-in pressure obtained by the traditional model calculation and the actual well shut-in pressure is as high as 14.79%, which is greater than 10%. The accuracy of the calculation result of the present disclosure is 14.17% higher than that of the traditional model, which is a significant improvement. The calculation result of the present disclosure is more in line with the actual working conditions.

To sum up, in the present disclosure, the plurality of factors including the wellhead device, the well wall stability, the well depth, and the casing strength, etc., are comprehensively considered, so that the maximum well shut-in pressure may be calculated more accurately and reasonably, which ensures the safety of the well shut-in process and provides an effective well shut-in pressure reference for the field. Compared with the prior art, the present disclosure has a significant improvement.

FIG. 3 is an exemplary flowchart of a process for determining an updated recommended well shut-in time according to some embodiments of the present disclosure. In some embodiments, the process 300 may be implemented by the first processor 110 of the system 100 for determining a well shut-in pressure of oil and gas well drilling. As shown in FIG. 3, the process 300 includes operations 310-350 as follows.

In 310, the first processor determines a recommended monitoring parameter and a recommended well drilling parameter based on a maximum well shut-in pressure and based on a wellhead pressure sequence and a bottomhole pressure sequence in a preset time period collected by a monitoring device.

More descriptions regarding the monitoring device may be found in the related descriptions of FIG. 1.

The preset time period refers to a time period that is a preset length of time before a current moment. The preset length of time may be preset by a person skilled in the art based on experience.

In some embodiments, since different well drilling condition features may affect a change of the wellhead pressure and a change of the bottomhole pressure of a target oil and gas well, the preset time period may be related to the well drilling condition feature, The well drilling condition feature refers to a feature related to a well drilling condition. For example, the well drilling condition feature may include one or more of a geological condition, a well depth, a well drilling fluid characteristic, etc. of the target oil and gas well. The well drilling fluid characteristic may include a flow rate, a flow velocity, a density, etc. of the well drilling fluid.

In some embodiments, the first processor may determine the preset time period based on the well drilling condition feature through a first preset comparison table. The first preset comparison table includes a correspondence between a reference well drilling condition feature and a reference preset time period. The first preset comparison table may be constructed based on priori knowledge or historical data.

In some embodiments of the present disclosure, the preset time period is determined based on the well drilling condition feature, so that the wellhead pressure sequence and the bottomhole pressure sequence in the preset time period collected by the monitoring device are more reasonable, which improves the accuracy of the finally predicted recommended monitoring parameter and the recommended well drilling parameter.

The wellhead pressure sequence refers to a sequence composed of a plurality of wellhead pressure values collected by the monitoring device in the preset time period.

The bottomhole pressure sequence refers to a sequence composed of a plurality of bottomhole pressure values collected by the monitoring device in the preset time period.

In some embodiments, the first processor may obtain the wellhead pressure sequence and the bottomhole pressure sequence through a pressure monitoring device.

The recommended monitoring parameter refers to a monitoring parameter used by a recommended monitoring device.

In some embodiments, the monitoring parameter may include one or more of a monitoring accuracy degree, a monitoring frequency, etc. of the monitoring device.

The recommended well drilling parameter refers to a parameter used by a recommended well drilling operation device in the well drilling process. The well drilling operation device refers to a device used during an well drilling operation. For example, the well drilling operation device includes a drilling rig, a well drilling fluid system (e.g., a well drilling fluid pump or a well drilling mud mixer), etc.

In some embodiments, the recommended well drilling parameter may include a recommended well shut-in time, a well drilling device parameter, or the like, or any combination thereof.

The recommended well shut-in time refers to a time recommended for shutting in the target oil and gas well.

The well drilling device parameter may include the density, a circulation speed, etc. of the well drilling fluid when the well drilling operation device works.

In some embodiments, the first processor may determine the recommended monitoring parameter and the recommended well drilling parameter in various ways. For example, the first processor may determine a first target feature vector based on the maximum well shut-in pressure and based on the wellhead pressure sequence and the bottomhole pressure sequence in the preset time period; determine a first reference feature vector with a same vector length as the first target feature vector through a vector database based on the first target feature vector; determine a first association feature vector based on the first reference feature vector; and determine a reference monitoring parameter and a reference well drilling parameter in a reference time period corresponding to the first association feature vector as the recommended monitoring parameter and the recommended well drilling parameter.

The vector database includes a plurality of first reference feature vectors, wherein each first reference feature vector has the reference monitoring parameter and the reference well drilling parameter in the corresponding reference time period. The reference monitoring parameter and the reference well drilling parameter in the corresponding reference time period of each first reference feature vector may be obtained based on historical data. The first reference feature vectors refer to feature vectors constructed based on historical maximum well shut-in pressures, and wellhead pressure sequences and a bottomhole pressure sequences in a historical time period. The first reference feature vectors in the vector database correspond to different reference time periods, and vector lengths of the first reference feature vectors are different.

In some embodiments, the first processor may construct the vector database based on the plurality of first reference feature vectors and reference monitoring parameters and reference well drilling parameters in their corresponding reference time periods. The constructed vector database may be stored in a storage device. When using, the first processor obtains the constructed vector database from the storage device.

In some embodiments, the first processor may determine, based on the vector length of the first target feature vector, the first reference feature vector in a reference database with the same vector length as the first target feature vector.

In some embodiments, the first processor may determine a first reference feature vector that meets a first preset condition in the first reference feature vectors with the same vector length and determine the first reference feature vector that meets the first preset condition to be the first association feature vector. The first preset condition refers to a judgment condition used to determine the first association feature vector. In some embodiments, the first preset condition may include that a vector distance between the first reference feature vector and the first target feature vector of the same vector length satisfies a first preset threshold.

In some embodiments, the first processor may determine the recommended monitoring parameter and the recommended well drilling parameter based on the reference monitoring parameter and the reference well drilling parameter corresponding to the determined first association feature vector.

In some embodiments, the first processor obtains a parameter recommendation model based on preliminary training and predicts the recommended well shut-in time by processing the maximum well shut-in pressure, the wellhead pressure sequence, and the bottomhole pressure sequence in the preset time period collected by the monitoring device based on the parameter recommendation model. In some embodiments, the parameter recommendation model may be a machine learning model.

The preliminary training refers to training of the parameter recommendation model based on undifferentiated and unlimited training sample data. That is, the training sample data used in the preliminary training process of the parameter recommendation model may be data collected under the same or different well drilling devices, well drilling schemes, and actual well drilling conditions.

In some embodiments, the parameter recommendation model obtained by the first processor based on the preliminary training is published to a second processor of each terminal device as a model for edge calculations.

In some embodiments, after obtaining the parameter recommendation model, the second processor of each terminal device may periodically perform enhanced training on the parameter recommendation model to obtain a parameter recommendation model that is more in line with the corresponding target oil and gas well. The duration of the periodicity may be preset by the person skilled in the art based on experience, for example, the enhanced training is performed automatically once after a preset fixed period.

In some embodiments, the training sample data of each periodic training may be re-collected and updated according to an actual well drilling situation of the target oil and gas well corresponding to itself.

In some embodiments of the present disclosure, the parameter recommendation model obtained by the second processor through the enhanced training is more suitable for the corresponding target oil and gas well, so that the recommended well shut-in time predicted for the target oil and gas well is more accurate.

In some embodiments, when the second processor of each terminal device performs enhanced training on the parameter recommendation model, the first processor may also continue to perform synchronous enhanced training. At the same time, if a second processor corresponding to a new target oil and gas well is subsequently communicatively connected to the first processor, the first processor may also continue to send its parameter recommendation model after enhanced training to the new second processor.

In some embodiments, the parameter recommendation model of the first processor, after the enhanced training is completed, is not issued again to the second processor that has completed the enhanced training of the parameter recommendation model. When the new second processor is added, a latest parameter recommendation model is issued to the new second processor, wherein the new second processor corresponds to the newly added target oil and gas well.

In some embodiments, the first processor may input the maximum well shut-in pressure, the wellhead pressure sequence, and the bottomhole pressure sequence in the preset period of time collected based on the monitoring device into the parameter recommendation model for processing, and the parameter recommendation model outputs the predicted recommended well shut-in time. More descriptions regarding the parameter recommendation model may be found in FIG. 4 and relevant descriptions thereof.

In 320, the first processor generates a monitoring adjustment instruction based on the recommended monitoring parameter and sending the monitoring adjustment instruction to the monitoring device.

The monitoring adjustment instruction may be used to adjust a monitoring parameter of the monitoring device to the recommended monitoring parameter.

In 330, the first processor generates a well drilling operation instruction based on the recommended well drilling parameter and sends the well drilling operation instruction to the second processor.

The well drilling operation instruction may be used to control the well drilling operation device to perform the well drilling operation with the recommended well drilling parameter.

The well drilling operation device refers to a device used in the well drilling operation, for example, the drilling rig or the well drilling fluid system. The well drilling fluid system may include the well drilling fluid pump, the well drilling mud mixer, or the like, or any combination thereof.

In some embodiments, the second processor is located at the terminal device, and different oil and gas well drillings may correspond to different terminal devices. The different terminal devices may correspond to a separate second processor. More descriptions regarding the second processor may be found in the related descriptions of FIG. 1.

In some embodiments, due to the adjustment of the well drilling parameter of the well drilling operation device, the wellhead pressure and the bottomhole pressure of the target oil and gas well may change. When the degree of the change in the wellhead pressure and/or the bottomhole pressure of the target oil and gas well is sufficiently large or exceeds a corresponding preset threshold, the well shut-in time needs to be re-predicted, and the first processor and the second processor may also perform operations 340-350 as follows.

In some embodiments, the preset thresholds corresponding to the wellhead pressure and the bottomhole pressure of the target oil and gas well may be different, which are preset by those skilled in the art based on experience.

In 340, in response to receiving a feedback signal from the monitoring device and/or a well drilling operation device, the first processor sends an update instruction to the second processor.

In some embodiments, the feedback signal may include a signal that the monitoring parameter of the monitoring device has been adjusted and/or a signal that the well drilling parameter of the well drilling operation device has been adjusted.

The update instruction may be used to control the second processor to re-obtain an updated wellhead pressure sequence and an updated bottomhole pressure sequence from the monitoring device after the monitoring parameter and/or well drilling parameter have been adjusted.

In 350, in response to receiving the update instruction, the second processor obtains the updated wellhead pressure sequence and the updated bottomhole pressure sequence from the monitoring device, processes the updated wellhead pressure sequence and the updated bottomhole pressure sequence, and determines an updated recommended well shut-in time based on the parameter recommendation model obtained from the first processor.

In some embodiments, the processing the updated wellhead pressure sequence and the updated bottomhole pressure sequence may include operations 510-540 as follows.

In 510, the second processor calculates a first similarity between the updated wellhead pressure sequence and a last set of wellhead pressure sequence before the update.

The first similarity refers to a degree of similarity between the updated wellhead pressure sequence and the last set of wellhead pressure sequence before the update.

In some embodiments, the first similarity may be negatively correlated with a vector distance between the updated wellhead pressure sequence and the last set of wellhead pressure sequence before the update.

In 520, the second processor calculates a second similarity between the updated bottomhole pressure sequence and a last set of bottomhole pressure sequence before the update.

The second similarity refers to a degree of similarity between the updated bottomhole pressure sequence and the last set of bottomhole pressure sequence before the update.

In some embodiments, the second similarity may be negatively correlated with a vector distance between the updated bottomhole pressure sequence and the last set of updated bottomhole pressure sequence before the update.

In 530, in response to the first similarity being smaller than a first preset threshold and/or the second similarity being smaller than a second preset threshold, determining that at least one set of the pressure sequences is too different and the recommended well shut-in time may need to be re-predicted.

The first preset threshold and the second preset threshold may be preset by those skilled in the art based on experience.

In 540, in response to the first similarity being greater than or equal to the first preset threshold and the second similarity being greater than or equal to the second preset threshold, determining that the two sets of pressure sequences are not much different and there is no need to re-predict the recommended well shut-in time, continuing to obtain the latest bottomhole pressure sequence and the latest bottomhole pressure sequence, and repeating the operations 510-540.

In some embodiments, the second processor may input, according to a processing result, the updated wellhead pressure sequence and the updated bottomhole pressure sequence when the processing result satisfies a preset processing condition into the parameter recommendation model, and determine an output of the parameter recommendation model as the updated recommended well shut-in time.

The processing result may include the first similarity and/or the second similarity obtained by the second processor through calculation.

In some embodiments, the processing result satisfying the preset processing condition may be that the first similarity is smaller than the first preset threshold and/or the second similarity is smaller than the second preset threshold.

In some embodiments of the present disclosure, before the well is shut, the obtained maximum well shut-in pressure, and based on the changes in the wellhead pressure sequence and the bottomhole pressure sequence in the preset time period collected by the monitoring device are calculated, the monitoring parameter of the monitoring device and the well drilling parameter of the well drilling operation device are adjusted timely, the updated wellhead pressure sequence and the updated bottomhole pressure sequence are re-obtained, and in response to the excessive difference between the updated wellhead pressure sequence and the last set of wellhead pressure sequence before the update and/or the excessive difference between the updated bottomhole pressure sequence and the last set of bottomhole pressure sequence before the update, the recommended well shut-in time is re-predicted for well shut-in, which further ensures that there is no abnormality in the subsequent well shut-in.

In some embodiments, the parameter recommendation model 400 may be used to predict a recommended well shut-in time 451 by processing a maximum well shut-in pressure 413, a wellhead pressure sequence 411 in a preset time period, and a bottomhole pressure sequence 412 in the preset time period.

In some embodiments, the parameter recommendation model 400 is a machine learning model. For example, the machine learning model includes a Neural Networks (NN) model, a Deep Neural Networks (DNN) model, or the like, or any combination thereof.

More descriptions regarding the maximum well shut-in pressure 413 may be found in the related descriptions of FIG. 2. More descriptions regarding the wellhead pressure sequence 411 in the preset time period, the bottomhole pressure sequence 412 in the preset time period, and the recommended well shut-in time 451 may be found in the related descriptions of FIG. 3.

In some embodiments, the parameter recommendation model 400 may include a sequence feature extraction layer 420 and a prediction layer 440. In some embodiments, both the sequence feature extraction layer 420 and the prediction layer 440 may be a NN model, a DNN model, or the like, or any combination thereof.

In some embodiments, the sequence feature extraction layer 420 and the 440 may be obtained through joint training.

In some embodiments, the sequence feature extraction layer 420 may be used to process the wellhead pressure sequence 411 and the bottomhole pressure sequence 412 in the preset time period and output a fused sequence feature 430.

The fused sequence feature 430 may be used to characterize the wellhead pressure sequence and the bottomhole pressure sequence in the preset time period.

More descriptions regarding the preset time period may be found in the related descriptions of the operation 310 of FIG. 3.

In some embodiments, the prediction layer 440 may be used to process the fused sequence feature 430 and the maximum well shut-in pressure 413 and output the recommended well shut-in time 451.

In some embodiments, the parameter recommendation model may be obtained by jointly training the sequence feature extraction layer and the prediction layer based on a plurality of first training samples with first labels. The process of joint training may be performed in the first processor.

In some embodiments, the first processor may obtain historical well drilling data corresponding to a plurality of sets of historical sample oil and gas wells. Each set of historical well drilling data includes a historical maximum well shut-in pressure, a wellhead pressure sequence and a bottomhole pressure sequence in a historical time period, and a historical actual well shut-in time. Each set of the first training samples may include the wellhead pressure sequence and the bottomhole pressure sequence in the historical time period of the historical sample oil and gas well, wherein under the historical drilling data, there is no abnormality in the subsequent operation of the historical sample oil and gas well. The first label may be a historical actual well shut-in time corresponding to the historical well drilling data. In some embodiments, the first label may be obtained from historical data In some embodiments, the plurality of first training samples with the first labels may be input into an initial sequence feature extraction layer, historical sample fused sequence features output by the initial sequence feature extraction layer may be input into an initial prediction layer, a loss function may be constructed through the first labels and the output results of the initial prediction layer, parameters of the initial sequence feature extraction layer and the initial prediction layer are iteratively updated based on the loss function through gradient descent or other manners until a condition is met, and a trained parameter recommendation model is obtained. The condition may be that the loss function is smaller than a threshold, converges, or a training period reaches a threshold.

In some embodiments of the present disclosure, the parameter recommendation model is trained using the maximum well shut-in pressure, the wellhead pressure sequence and the bottomhole pressure sequence in the preset time period that may be obtained before the well is shut in, so that the parameter recommendation model learns the relationship between the wellhead pressure and bottomhole pressure under the boundary of the safety threshold and the actual well shut-in pressure, which accurately predicts the recommended well shut-in time and ensures that there is no abnormality subsequently after the target oil and gas well is shut in at the recommended well shut-in time.

In some embodiments, the first processor may send the trained parameter recommendation model to second processors of different terminal devices corresponding to different oil and gas well drillings.

In some embodiments, the different oil and gas well drillings may correspond to the different terminal devices. More descriptions regarding the terminal devices may be found in the related descriptions of FIG. 1.

In some embodiments, the second processors and the monitoring devices may be disposed in the terminal devices.

In some embodiments, the second processors of the different terminal devices may perform enhanced training on the parameter recommendation model based on the well drilling feature information of the oil and gas wells corresponding to the different terminal devices.

The well drilling feature information refers to feature information related to well drilling. The well drilling feature information may include at least one of a depth, a well inclination angle, a maximum well shut-in pressure, a formation feature, etc. of the drilled well.

The enhanced training refers to a process of re-training the parameter recommendation model sent by the first processor using actual well drilling data of historical well drilling that is similar to the well drilling feature information of the target oil and gas well as a training sample. The actual well drilling data includes an actual maximum well shut-in pressure, an actual wellhead pressure sequence in the historical time period, and an actual bottomhole pressure sequence in the historical time period.

In some embodiments, the second processor may determine the training sample of the enhanced training through operations 610-650 as follows.

In 610, based on the well drilling feature information of the plurality of historical wells, a first feature vector of each historical well is constructed. There is actual well drilling data corresponding to each first feature vector.

In 620, a center of clustering of each cluster is determined by performing clustering based on the first feature vector of each historical well.

In 630, for each newly added well, a second feature vector is constructed based on the well drilling feature information of the newly added well.

In 640, a vector distance between the second feature vector and each center of clustering is calculated, and a cluster whose vector distance satisfies a preset condition (e.g., the vector distance is the smallest) is determined to be a cluster in which the newly added well is located.

In 650, actual well drilling data of historical wells within the cluster in which the newly added well is located is used as the training sample of the enhanced training.

In some embodiments, the process that the second processors of the different terminal devices perform the enhanced training on the parameter recommendation model obtained from the first processor based on the actual well drilling data of the corresponding oil and gas well includes operations 710-760 as follows.

In 710, the second processor obtains actual well drilling data of the oil and gas wells corresponding to the different terminal devices from a storage device as the training sample of the enhanced training.

The actual well drilling data of the oil and gas wells refers to actual well drilling data of wells that are in the same cluster as the drilling feature information of a current well. More descriptions regarding the actual well drilling data may be found in related descriptions above.

In 720, the second processor obtains a predicted value by inputting the training sample into the parameter recommendation model obtained by the first processor.

The predicted value may be is a recommended well shut-in time value obtained by predicting based on the parameter recommendation model obtained by the first processor.

In 730, the second processor determines a difference value based on the predicted value and a labeled value of the training sample and sends the difference value to the first processor.

The difference value refers to a difference value between the predicted value and the labeled value corresponding to the enhanced training sample. The difference value may be used to construct a first loss function to optimize the parameters of the parameter recommendation model after the second processor performs the enhanced training.

In 740, the first processor generates a fused difference value by fusing the difference values obtained from different second processors.

The fused difference value may characterize an average difference of a plurality of difference values obtained from the different second processors.

In some embodiments, the first processor may obtain the fused difference value by averaging the difference values from the different second processors. The fused difference value may be used to construct a second loss function to optimize the parameters of the parameter recommendation model obtained by the first processor through training.

In 750, the second processor constructs the first loss function based on the difference values and updates the parameter recommendation model of the second processor based on the first loss function.

The first loss function may be used to characterize a degree to which the predicted value deviates from the labeled value used for the enhanced training.

In some embodiments, the second processor may construct the first loss function based on a combination of an existing loss function and the difference values. The existing loss function may include a 0-1 loss function, a binary cross-entropy loss function, etc.

In some embodiments, the second processor may iteratively update the parameters of the parameter recommendation model sent by the first processor through gradient descent or other manners based on the first loss function until a condition is satisfied and obtain the parameter recommendation model after the enhanced training. The condition may be that the first loss function is smaller than a threshold, converges, or a training period reaches a threshold, etc.

In 760, the first processor constructs the second loss function based on the fusion difference value and updates the parameter recommendation model of the first processor based on the second loss function.

The second loss function may be used to characterize a degree to which the fusion difference value deviates from the labeled value used for preliminary training. More descriptions regarding the preliminary training may be found in the related description of FIG. 3.

In some embodiments, the first processor may construct the second loss function based on a combination of the existing loss function and the fused difference value.

In some embodiments, the first processor may iteratively update the parameters of the parameter recommendation model of the first processor, through gradient descent or other manners based on the second loss function until the condition is satisfied and obtain the parameter recommendation model after obtaining the update. The condition may be that the second loss function is smaller than a threshold, converges, or a training period reaches a threshold, etc.

In some embodiments of the present disclosure, the second processor performs the enhanced training using actual well drilling data corresponding to historical well drillings similar to the well drilling feature information, so that a more targeted parameter recommendation model after the enhanced training is obtained, which improves the accuracy of the prediction result of the parameter recommendation model after the enhanced training.

Additionally, through the second processor located on each terminal device and the first processor located on the remote device, periodical enhanced training may be performed on the parameter recommendation model located on each first processor or the second processor, respectively, and when the new second processor is added, the first processor issues the latest parameter recommendation model to the new second processor, which ensures synchronous enhanced training of the parameter recommendation model of each terminal device.

Having thus described the basic concepts, it may be rather apparent to those skilled in the art after reading this detailed disclosure that the foregoing detailed disclosure is intended to be presented by way of example only and is not limiting. Although not explicitly stated here, those skilled in the art may make various modifications, improvements and amendments to the present disclosure. These alterations, improvements, and modifications are intended to be suggested by this disclosure, and are within the spirit and scope of the exemplary embodiments of this disclosure.

Moreover, certain terminology has been used to describe embodiments of the present disclosure. For example, the terms "one embodiment," "an embodiment," and/or "some embodiments" mean that a particular feature, structure or characteristic described in connection with the embodiment is included in at least one embodiment of the present disclosure. Therefore, it is emphasized and should be appreciated that two or more references to "an embodiment" or "one embodiment" or "an alternative embodiment" in various parts of the present disclosure are not necessarily all referring to the same embodiment. In addition, some features, structures, or features in the present disclosure of one or more embodiments may be appropriately combined.

Furthermore, unless explicitly stated in the claims, the order of processing elements and sequences, the use of alphanumeric, or the use of other names described in the present disclosure is not intended to limit the order of the processes and methods of the present disclosure. While the above disclosure discusses some presently believed useful embodiments of the invention by way of various examples, it is to be understood that such details are for purposes of illustration only and that the appended claims are not limited to the disclosed embodiments, but on the contrary, the claims are intended to cover all modifications and equivalent combinations that come within the spirit and scope of the embodiments of the present disclosure. For example, although the implementation of various components described above may be embodied in a hardware device, it may also be implemented as a software only solution, e.g., an installation on an existing server or mobile device.

Similarly, it should be appreciated that in the foregoing description of embodiments of the present disclosure, various features are sometimes grouped together in a single embodiment, figure, or description thereof for the purpose of streamlining the disclosure aiding in the understanding of one or more of the various embodiments. However, this approach of disclosure does not imply that the features required by the present disclosure are more than the features recited in the claims. Rather, claimed subject matter may lie in less than all features of a single foregoing disclosed embodiment.

In some embodiments, the numbers expressing quantities or properties used to describe and claim certain embodiments of the present disclosure are to be understood as being modified in some instances by the term "about," "approximate," or "substantially." For example, "about," "approximate," or "substantially" may indicate ±20% variation of the value it describes, unless otherwise stated. Accordingly, in some embodiments, the numerical parameters set forth in the written description and attached claims are approximations that may vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the present disclosure are approximations, the numerical values set forth in the specific examples are reported as precisely as practicable.

Each patent, patent application, patent application publication, and other material, such as article, book, specification, publication, document, etc., cited in the present disclosure is hereby incorporated by reference in its entirety. Historical application documents that are inconsistent with or conflict with the content of the present disclosure are excluded, and documents (currently or later appended to the present disclosure) that limit the broadest scope of the claims of the present disclosure are excluded. It should be noted that if there is any inconsistency or conflict between the descriptions, definitions, and/or terms used in the accompanying materials of the present disclosure and the contents of the present disclosure, the descriptions, definitions, and/or terms used in the present disclosure shall prevail.

Finally, it should be understood that the embodiments described in the present disclosure are only configured to illustrate the principles of the embodiments of the present disclosure. Other modifications are also possible within the scope of the present disclosure. Therefore, as an example and not a limitation, alternative configurations of the embodiments of the present disclosure may be regarded as consistent with the teaching of the present disclosure. Correspondingly, the embodiments of the present disclosure are not limited to the embodiments clearly introduced and described in the present disclosure.

What is claimed is:

1. A method for determining a well shut-in pressure of oil and gas well drilling, comprising:

obtaining, by a first processor, a basic parameter of a target oil and gas well, the basic parameter including at least one of a wellbore structure parameter, a well drilling fluid performance parameter, or a casing string parameter; wherein the pressure calculation model is:

$$P_{Cmax} = \min\begin{Bmatrix} P_1 = 0.8(\min\{P_T, P_R\}); \\ P_2 = P_{ba} - P_{be}; \\ P_3 = 0.8(0.0098\rho_f H_f); \end{Bmatrix} \quad (1)$$

where $P_{cmax}$ denotes the maximum well shut-in pressure in MPa; $P_1$ denotes a minimum value of pressure limitation of a wellhead device in MPa; $P_T$ denotes a maximum test pressure of a support casing of the wellhead device in MPa; $P_R$ denotes a rated working pressure of the support casing of the wellhead device in MPa; $P_2$ denotes a minimum value of pressure limitation of the casing string in MPa; $p_{ba}$ denotes a maximum internal pressure strength of the casing string in MPa; $P_{be}$ denotes an effective internal pressure of the casing string in MPa: $P_3$ denotes a minimum value of a formation rupture pressure limitation in MPa; $\rho_f$ denotes a well drilling fluid density in g/cm$^3$; $H_f$ denotes a formation depth (vertical depth) corresponding to a position of a casing shoe in m; $P_{cmax}$, $P_1$, $P_2$, $p_{ba}$, $P_{be}$, and $P_3$ are calculated by the first processor; and $P_R$, $P_R$, $\rho_f$, and $H_f$ are obtained by the first processor from the monitoring device;

obtaining, by the first processor, a pressure calculation model;

determining, by the first processor, a maximum well shut-in pressure during well drilling of the target oil and gas well based on the pressure calculation model and the basic parameter;

determining, by the first processor, a recommended monitoring parameter and a recommended well drilling parameter based on the maximum well shut-in pressure and a wellhead pressure sequence and a bottomhole pressure sequence in a preset time period collected by a monitoring device;

generating, by the first processor, a monitoring adjustment instruction based on the recommended monitoring parameter and sending the monitoring adjustment instruction to the monitoring device to adjust a monitoring parameter of the monitoring device to the recommended monitoring parameter, wherein the monitoring device includes a pressure monitoring device, a density detection device, a depth detection device and a length measurement device, the monitoring parameter includes a monitoring accuracy degree and a monitoring frequency of the monitoring device; and generating, by the first processor, a well drilling operation instruction based on the recommended well drilling parameter and sending the well drilling operation instruction to a second processor, the second processor being located at a terminal device, wherein the well drilling operation instruction is used to control the well drilling operation device to perform the well drilling operation with the recommended well drilling parameter, the well drilling operation device includes a drilling rig, a well drilling fluid pump and a well drilling mud mixer, the recommended well drilling parameter includes a recommended well shut-in time and a well drilling device parameter, the well drilling device parameter includes a density and a circulation speed of the well drilling fluid when the well drilling operation device works.

2. The method according to claim 1, wherein the determining, by the first processor, a recommended well drilling parameter based on the maximum well shut-in pressure and based on a wellhead pressure sequence and a bottomhole pressure sequence in a preset time period collected by a monitoring device includes:

obtaining, by the first processor, a parameter recommendation model based on preliminary training; and predicting, by the first processor, the recommended well shut-in time by processing the maximum well shut-in pressure, the wellhead pressure sequence, and the bottomhole pressure sequence based on the parameter recommendation model, the parameter recommendation model being a machine learning model.

3. The method according to claim 2, further comprising:

in response to receiving a feedback signal from the monitoring device and/or a well drilling operation device, sending, by the first processor, an update instruction to the second processor; and in response to receiving the update instruction, obtaining, by the second processor, an updated wellhead pressure sequence and an updated bottomhole pressure sequence from the monitoring device, processing the updated wellhead pressure sequence and the updated bottomhole pressure sequence, and determining an updated recommended well shut-in time based on the parameter recommendation model obtained from the first processor.

4. The method according to claim 2, wherein the parameter recommendation model includes:

a sequence feature extraction layer, an input of the sequence feature extraction layer including the wellhead pressure sequence and the bottomhole pressure sequence and an output of the sequence feature extraction layer including a fused sequence feature; and a prediction layer, an input of the prediction layer including the fused sequence feature and the maximum well shut-in pressure and an output of the prediction layer including the recommended well shut-in time, wherein the sequence feature extraction layer and the prediction layer are obtained through joint training.

5. The method according to claim 4, wherein different oil and gas wells correspond to different terminal devices, and different second processors and different monitoring devices corresponding to the different oil and gas wells are disposed in the different terminal devices; and the second processors of the different terminal devices perform enhanced training on the parameter recommendation model based on well drilling feature information of the oil and gas wells corresponding to the different terminal devices, including:

for each of the different second processors and each of the different oil and gas wells corresponding to the each of the different second processors, obtaining, by the second processor, actual well drilling data of the oil and gas well from a storage device as a training sample of the enhanced training;

obtaining, by the second processor, a predicted value by inputting the training sample into the parameter recommendation model obtained by the first processor; and determining, by the second processor, a difference value based on the predicted value and a labeled value of the training sample and sending the difference value to the first processor:

constructing, by the second processor, a first loss function based on the difference values and updating the parameter recommendation model of the second processor based on the first loss function;

generating, by the first processor, a fused difference value by fusing different difference values obtained from the different second processors; and constructing, by the first processor, a second loss function based on the fused difference value and updating the parameter recommendation model of the first processor based on the second loss function.

6. The method according to claim 1, wherein the maximum internal pressure strength of the casing string is calculated by:

$$P_{ba} = P_{ba1} + \Delta p_{ba} \tag{2}$$

$$p_{ba1} = 0.8 \times 2\delta_{ymn}(k_{wall}t_{wall})/D_{out} \tag{3}$$

$$\Delta p_{ba} = 0.2 \times \frac{2k_{dr}\delta_{tmn}(k_{wall}t_{wall} - k_a f_N)}{D_{out} - (k_{wall}t_{wall} - k_a f_N)} \tag{4}$$

where $p_{ba1}$ denotes an internal pressure of the casing string when the casing string satisfies a yield strength in MPa; $\Delta p_{ba}$ denotes a safety margin of an internal pressure strength of the casing string in MPa; $\delta_{ymn}$ denotes a minimum yield strength in MPa; $k_{wall}$ denotes a tolerance factor of a casing string wall without a dimension; $t_{wall}$ denotes a wall thickness of the casing string in mm; $D_{out}$ denotes an outer diameter of the casing string in mm; $k_{dr}$ denotes a correction factor of hardening based on material stress-strain characteristics without a dimension; $\delta_{tmn}$ denotes a minimum tensile strength in MPa; $k_a$ denotes an internal pressure strength factor without a dimension; and $f_N$ denotes a defect depth in mm.

7. The method according to claim 6, wherein the wall thickness of the casing string is calculated and determined by the first processor based on measured values of wall thicknesses of the casing string at a plurality of positions;

the outer diameter of the casing string is calculated and determined by the first processor based on measured values of outer diameters of the casing string at the plurality of positions; and the measured values of wall thicknesses of the casing string and the measured values of outer diameters of the casing string are obtained by a logging device and transmitted to the first processor.

8. The method according to claim 7, wherein the plurality of positions are determined by the first processor based on appearance features of the casing string and an order in which the casing string is lowered to the well, and the appearance features of the casing string are determined based on scanning data of the casing string; and obtaining the measured values of wall thicknesses of the casing string and the measured values of outer diameters of the casing string based on a logging device includes:

completing monitoring, through the logging device, based on the plurality of positions to obtain the measured values of wall thicknesses of the casing string and the measured values of outer diameters of the casing string, the logging device including an electronic logging instrument.

9. The method according to claim 6, wherein the correction factor of hardening based on material stress-strain characteristics is calculated by:

$$k_{dr} = (1/2)^{n+1} + (1/\sqrt{3})^{n+1} \tag{5}$$

where n denotes a hardening index without a dimension.

10. The method according to claim 1, wherein the effective internal pressure of the casing string is calculated by:

$$P_{be} = P_{bh} - 0.00981\rho_c H \tag{6}$$

$$P_{bh} = 0.00981(a\rho_w + b\rho_g)H \tag{7}$$

where $P_{bh}$ denotes an internal pressure of the casing string of a certain well section and a certain well depth in MPa; $\rho_c$ denotes a formation fluid density in g/cm$^3$; H denotes the well depth in m; a denotes a proportion of a volume of well drilling fluid in a wellbore to a wellbore volume in %; $\rho_w$ denotes the well drilling fluid density in g/cm$^3$; b denotes a proportion of a volume of gas in the wellbore to the wellbore volume in %; and $\rho_g$ denotes a density of gas intruding into the wellbore in g/cm$^3$.

11. A system for determining a well shut-in pressure of oil and gas well drilling, comprising a first processor, wherein the first processor is configured to:

obtain a basic parameter of a target oil and gas well, the basic parameter including at least one of a wellbore structure parameter, a well drilling fluid performance parameter, or a casing string parameter r; wherein the pressure calculation model is:

$$P_{Cmax} = \min\begin{Bmatrix} P_1 = 0.8(\min\{P_T, P_R\}); \\ P_2 = P_{ba} - P_{be}; \\ P_3 = 0.8(0.0098\rho_f H_f); \end{Bmatrix} \quad (1)$$

where $P_{cmax}$ denotes the maximum well shut-in pressure in MPa; $P_1$ denotes a minimum value of pressure limitation of a wellhead device in MPa; $P_T$ denotes a maximum test pressure of a support casing of the wellhead device in MPa; $P_R$ denotes a rated working pressure of the support casing of the wellhead device in MPa; $P_2$ denotes a minimum value of pressure limitation of the casing string in MPa; $p_{ba}$ denotes a maximum internal pressure strength of the casing string in MPa; $P_{be}$ denotes an effective internal pressure of the casing string in MPa; $P_3$ denotes a minimum value of a formation rupture pressure limitation in MPa; $\rho_f$ denotes a well drilling fluid density in g/cm$^3$; $H_f$ denotes a formation depth (vertical depth) corresponding to a position of a casing shoe in m; $P_{cmax}$, $P_1$, $P_2$, $P_{ba}$, $P_{be}$, and $P_3$ are calculated by the first processor; and $P_T$, $P_R$, $\rho_f$, and $H_f$ are obtained by the first processor from the monitoring device; and obtain a pressure calculation model;

determine a maximum well shut-in pressure during well drilling of the target oil and gas well based on the pressure calculation model and the basic parameter;

determine a recommended monitoring parameter and a recommended well drilling parameter based on the maximum well shut-in pressure and a wellhead pressure sequence and a bottomhole pressure sequence in a preset time period collected by a monitoring device;

generate a monitoring adjustment instruction based on the recommended monitoring parameter and sending the monitoring adjustment instruction to the monitoring device to adjust a monitoring parameter of the monitoring device to the recommended monitoring parameter, wherein the monitoring device includes a pressure monitoring device, a density detection device, a depth detection device and a length measurement device, the monitoring parameter includes a monitoring accuracy degree and a monitoring frequency of the monitoring device; and generate a well drilling operation instruction based on the recommended well drilling parameter and sending the well drilling operation instruction to a second processor, the second processor being located at a terminal device, wherein the well drilling operation instruction is used to control the well drilling operation device to perform the well drilling operation with the recommended well drilling parameter, the well drilling operation device includes a drilling rig, a well drilling fluid pump and a well drilling mud mixer, the recommended well drilling parameter includes a recommended well shut-in time and a well drilling device parameter, the well drilling device parameter includes a density and a circulation speed of the well drilling fluid when the well drilling operation device works.

12. The system according to claim 11, wherein the first processor is further configured to:

obtain a parameter recommendation model based on preliminary training; and predicting the recommended well shut-in time by processing the maximum well shut-in pressure, the wellhead pressure sequence, and the bottomhole pressure sequence based on the parameter recommendation model, the parameter recommendation model being a machine learning model.

13. The system according to claim 11, wherein the maximum internal pressure strength of the casing string is calculated by:

$$P_{ba} = P_{ba1} + \Delta p_{ba} \quad (2)$$

$$p_{ba1} = 0.8 \times 2\delta_{ymn}(k_{wall}t_{wall})/D_{out} \quad (3)$$

$$\Delta p_{ba} = 0.2 \times \frac{2k_{dr}\delta_{tmn}(k_{wall}t_{wall} - k_a f_N)}{D_{out} - (k_{wall}t_{wall} - k_a f_N)} \quad (4)$$

where $p_{ba1}$ denotes an internal pressure of the casing string when the casing string satisfies a yield strength in MPa; $\Delta p_{ba}$denotes a safety margin of an internal pressure strength of the casing string in MPa; $\delta y_{ymn}$ denotes a minimum yield strength in MPa; $k_{wall}$ denotes a tolerance factor of a casing string wall without a dimension; $t_{wall}$ denotes a wall thickness of the casing string in mm; $D_{out}$ denotes an outer diameter of the casing string in mm; kdenotes a correction factor of hardening based on material stress-strain characteristics without a dimension; $\delta_{tmn}$ denotes a minimum tensile strength in MPa; $k_a$ denotes an internal pressure strength factor without a dimension; and $f_N$ denotes a defect depth in mm.

14. The system according to claim 13, wherein the correction factor of hardening based on material stress-strain characteristics is calculated by:

$$k_{dr} = (1/2)^{n+1} + (1/\sqrt{3})^{n+1} \quad (5)$$

where n denotes a hardening index without a dimension.

15. The system according to claim 11, wherein the effective internal pressure of the casing string is calculated by:

$$P_{be} = P_{bh} - 0.00981\rho_c H \quad (6)$$

$$P_{bh} = 0.00981(a\rho_w + b\rho_g)H \quad (7)$$

where $P_{bh}$ denotes an internal pressure of the casing string of a certain well section and a certain well depth in MPa; $\rho_c$ denotes a formation fluid density in g/cm$^3$; H denotes the well depth in m; a denotes a proportion of a volume of well drilling fluid in a wellbore to a wellbore volume in %; $p_w$ denotes the well drilling fluid density in g/cm$^3$; b denotes a proportion of a volume of gas in the wellbore to the wellbore volume in %; and $\rho_g$ denotes a density of gas intruding into the wellbore in g/cm$^3$.

* * * * *